313-414
7/17/84 XR 4,460,844 SR

United States Patent [19]

Sakurai et al.

[11] Patent Number: 4,460,844

[45] Date of Patent: Jul. 17, 1984

[54] MAGNETIC FOCUSING, THREE IN-LINE GUN TYPE COLOR PICTURE TUBE

[75] Inventors: Soichi Sakurai, Yokohama; Kyohei Fukuda, Fujisawa; Kuniharu Osakabe, Mobara, all of Japan

[73] Assignee: Hitachi, Ltd., Tokyo, Japan

[21] Appl. No.: 329,045

[22] Filed: Dec. 9, 1981

[30] Foreign Application Priority Data

Dec. 15, 1980 [JP] Japan ..... 55-175814
Jun. 8, 1981 [JP] Japan ..... 56-86937

[51] Int. Cl.[3] ..... H01J 29/51; H01J 29/68

[52] U.S. Cl. ..... 313/412; 313/414; 313/417; 313/457

[58] Field of Search ..... 313/412, 414, 417, 442, 313/457, 428, 431, 433

[56] References Cited

U.S. PATENT DOCUMENTS 4,096,408 6/1978 Bozzay et al. ..... 313/417

FOREIGN PATENT DOCUMENTS 55-1059 1/1980 Japan ..... 313/412
55-37715 3/1980 Japan ..... 313/412

*Primary Examiner*—Eugene R. LaRoche
*Assistant Examiner*—Vincent DeLuca
*Attorney, Agent, or Firm*—Antonelli, Terry & Wands

[57] ABSTRACT

A color television picture tube of three in-line gun type wherein a ring-shaped ferrite permanent magnet or magnets are disposed around a neck portion of the tube, at least a pair of mutually-opposing pole pieces made of highly permeable magnetic material are provided within the tube neck portion as a part of the gun assembly so as to be magnetized by the ring magnet or magnets and to form an electron beam magnetic focusing lens system. In the picture tube, the pole pieces are each of a substantially elliptical cross section as viewed from a plane perpendicular to the tube axis, and spaces are provided between an inner wall of the tube neck portion and the pole pieces to accommodate support rods for gun assembling. There are selected to fall in particular ranges the ratio of the outer diameter to inner diameter of the permanent magnet, the ratio of the thickness to inner diameter thereof, the ratio of the thickness to gap length between the opposing pole pieces, and the ratio of the tube-axial length of the pole piece disposed on the side of a phosphor screen to the tube-axial length of the pole piece disposed on the side of cathode electrodes.

10 Claims, 15 Drawing Figures

MAGNETIC FOCUSING, THREE IN-LINE GUN TYPE COLOR PICTURE TUBE

BACKGROUND OF THE INVENTION

This invention relates to an electromagnetic focusing cathode-ray tube of external magnet type which allows an easy and accurate assembling of an electron gun unit therein.

An electrostatic focusing electron gun has been predominately employed, so far, in a prior-art color television cathode-ray tube, mainly because of its easy assembling, less weight, small size and low manufacturing cost. Recently a strong and increasing demand for a color television cathode-ray tube is to raise its picture resolution. To comply with this demand, various types of electrostatic focusing electron guns have been developed but it appears that the limit for further increasing the resolution has been reached.

An electromagnetic focusing electron gun, on the other hand, is advantageous in that a higher picture resolution can be more easily obtained since the lens has a smaller spherical aberration and it is easier to avoid a beam spreading tendency by a repulsion force to which the electrons are subjected. In addition, this type of electron gun has less possibility of occurrence of discharge between electrodes than the electrostatic focusing electron gun. As an example of known magnetic focusing cathode-ray tubes of this type, there has been disclosed in Japanese Patent Application Laid-Open No. 106350/81 (which is laid open on Aug. 24, 1981 and whose assignee is the same as that of the present invention), a three in-line gun picture tube of external permanent magnet type, as shown in FIGS. 1 to 3, in which a permanent ring magnet is mounted around a neck portion of the picture tube as means for generating condensed or focused magnetic field, a plurality of substantially cylindrical magnetic pole pieces are disposed within said neck portion, said pole pieces are each provided in its bottom wall with through-holes for electron-beam passage which are made of magnetic material of high permeability in order to effectively absorb or attract magnetic flux emitted from the magnet, and the pole pieces are aligned with their beam paths to form main magnetic focusing lenses in the gap between the opposing pole pieces.

Prior to a disclosure of the present invention, the prior art picture tube will now be detailed for more understanding of the present invention with reference to FIGS. 1 to 3. FIG. 1 is a cross-sectional view of an exemplary prior-art magnetic focusing cathode-ray tube of external permanent magnet type, taken along a plane of three in-line gun assembly thereof, FIG. 2 is a cross-sectional view of the same picture tube, taken along a plane which includes an axis of the tube and is perpendicular to the three in-line gun assembly plane, and FIG. 3 is a cross-sectional view of the tube taken along line III—III in FIGS. 1 and 2. A neck portion 1 of the prior art tube comprises cathodes 2 which emit a central beam 12C and side beams $12S_1$ and $12S_2$, first grids 3, second grids 4, a pair of magnetic pole pieces 5 disposed as mutually opposed and made of magnetic material having a high magnetic permeability, resilient conductive spring members 6, an internal conductive film 7, a permanent ring-shaped magnet 8, electrode supporting rods made of high-voltage resistive glass, a deflecting yoke 10, stem pins 9, a main magnetic lens system 13 symbolically illustrated as an optical lens system, a gap electrode 14 of nonmagnetic material such as stainless which functions to provide a desired spacing between the magnetic pole pieces, and a third grid bottom 15 mounted onto the pole piece on the cathode side and made of such non-magnetic material as stainless. In operation, the central and side beams 12C, $12S_1$ and $12S_2$ emitted from the cathodes 2 are passed through the respective first and second grids 3 and 4 so as to form a cross-over. Thereafter, the beams are accelerated by the third bottom 15 to which an anode potential is applied through the conductive spring members 6, by the pole piece pair 5 and by the gap electrode 14. The accelerated beams are passed through respective apertures **5*a* and the main magnetic lenses to form a cross-over image on a phosphor screen (not shown) of the tube. Since the bottomed cylindrical pole pieces 5 are made of highly permeable magnetic material, the pieces effectively attract magnetic flux emanating from the permanent magnet 8 such that highly condensed or focused magnetic fields taken place along the respective electron beams in the gap 5*g* between the opposing bottoms of the paired pole pieces, thereby forming a main magnetic focusing system 13. In order to make a true circle the spot formed on the fluorescent or phosphor screen by reducing the occurrence of non-point aberration and also to focus and converge three color beams into a point on a not shown mask (i.e. static convergence (often referred to as STC hereinafter)); in the prior art, the magnetic pole pieces 5 are each shaped to be circular in cross-section as viewed from a plane perpendicular to the tube axis to obtain a stronger rotary and symmetrical focused magnetic field, as best seen from FIG. 3. As a result, the electron gun must be assembled according to such steps that the cathodes 2 and first to third grids 3, 4, 15** are first carried on the glass support rods, then the pole pieces on the cathode side, the gap electrode and the pole pieces on the side of the phosphor screen are mounted on said carried support rods in the order listed above, and lastly the overlapped portions thereof are welded. Since it is impossible to support the magnetic pole pieced directly by the electrode supporting rods, such assembling will disadvantageously require an increased number of steps, which leads to the fact that the manufacturing cost is increased and it is difficult to raise the assembling accuracy of the gun to a desired level.

In order to eliminate the above problems, the inventor of the present invention has suggested in Japanese Patent Application Laid-Open No. 78047/81 (laid open on June 26, 1981) a gun assembly or unit wherein the electrode supporting rods 9 are extended to the side portions of the cylindrical magnetic pole pieces 5 so as to carry the pole pieces together with cathodes and gate electrodes. With this arrangement, however, the neck portion of the tube is too small in the available space to accommodate therein the support rods 9 of desired size. For this reason, there is a danger in this type of gun unit that magnetic pole pieces 5 are insufficient in its supporting strength and thus the gun tends to easily break in the vicinity of the pole pieces due to a mechanical shock. As a way to meet both the assembling accuracy and supporting strength requirements as mentioned above, there has been disclosed such an arrangement as shown in FIGS. 4 and 9 wherein magnetic pole pieces are supported by the electrode supporting rods 9, in U.S. Patent Ser. No. 917179 to Fukuda filed June 20, 1978 and assigned to the present assignee, now U.S. Pat.

No. 4,345,183. In this structure, however, since the electrode supporting rods 9 are exposed to the electron beam path and the electron beams 12C, 12S$_1$ and 12S$_2$ are positioned very close to the rods 9, these beams tend to be subject to influence of the rods 9 due to the electric field. This will result in the fact that the STC undesirably varies during operation of the electron gun, thereby making it difficult to put it into practical applications.

SUMMARY OF THE INVENTION

An object of the present invention is accordingly to provide a magnetic focusing cathode-ray tube including a three in-line electron gun which eliminates such problems in prior art as mentioned above, allows easy assemblage with high assembling accuracy, and exhibits excellent performance.

Another object of the present invention is to provide a three in-line electron gun assembly of the magnetic focusing cathode-ray tube of external magnet type which produces a beam spot in the form of a true circle and which exhibits good static convergence.

In accordance with an aspect of the present invention, the above objects can be accomplished by making the cross-sectional profile of the magnetic pole pieces substantially elliptical as seen from a plane perpendicular to the tube axis and by positioning supporting members in the middle of major axes of the profile sectional ellipses and supporting the magnetic pole pieces. In this connection, the supporting members may be usually replaced by the electrode supporting rods which has been used for support of other electrodes in the prior art electron gun but which is made slightly longer in length.

According to another aspect of the present invention, the magnetic pole pieces are made non-circular in cross section as viewed from a plane perpendicular to the tube axis, the pole pieces are supported by common electrode supporting rods together with other electrodes, and the permanent magnet is made of ferrite material decreasing cost performance. Further, the configuration of the permanent magnet, a gap "lg" between the pole pieces, and axial lengths "$h_u$" and "$h_b$" of each pole piece are experimentally dimensioned so that provision of non-circular cross sections for the pole pieces will not have adverse effect on the beam spot profile and good static convergence and performance can be obtained.

BRIEF DESCRIPTION OF THE DRAWINGS

The above and other objects and advantages of the present invention will become clear from the following description with reference to the accompanying drawings, in which.

DESCRIPTION OF THE PREFERRED EMBODIMENTS

Figure 5:
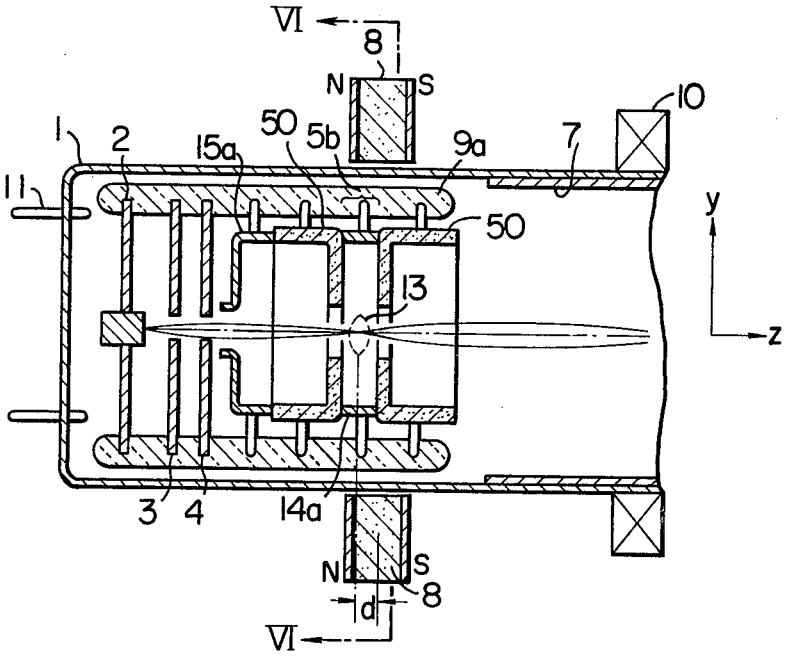
FIG. 5 is a longitudinal cross-sectional view of an electron gun in accordance with an embodiment of the present invention.
Figure 6:
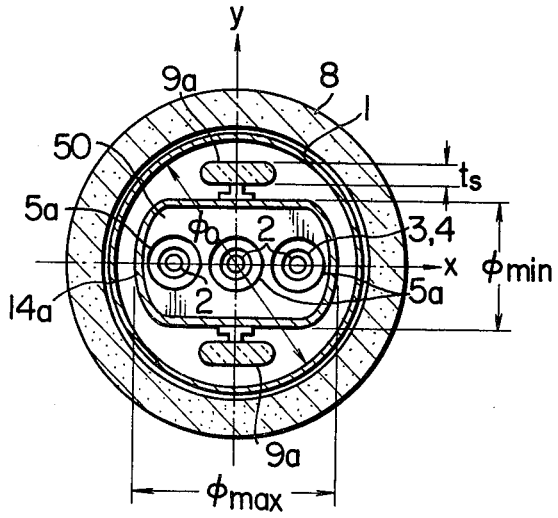
FIG. 6 is a cross-sectional view of the electron gun taken along line VI—VI in FIG. 5.

Turning now to FIGS. 5 and 6, there is shown an exemplary magnetic focusing cathode-ray tube of three in-line gun, external magnet type according to an embodiment of the present invention, which comprises electrode supporting rods **9*a* for directly supporting magnetic pole pieces 50 (which will be explained later), a gap electrode somewhat flatly shaped so as to match with the profile of the pieces therebetween and forming an essential component of the present invention, a third grid bottom 15*a* somewhat flatly shaped so as to match with the profile of the adjacent pole piece, and the magnetic pole pieces 50 forming an essential component of the present invention. As best seen from FIG. 6, the profile of the pole pieces 50** is not a circle when viewed from a plane perpendicular to the tube axis unlike in the prior art, but shaped substantially as an ellipse whose major axis is registered with the "x" direction of the picture tube. Such a structure enables much easier assembling of the electron gun and significantly increased assembling accuracy thereof when compared with the conventional gun.

The physical configuration of the pole pieces according to the present invention will be next detailed in conjunction with FIG. 6. Each pole piece, as shown in FIGS. 5 and 6, may be considered to be formed of a base-plate of substantially elliptical configuration extending perpendicularly to the tube axis and a flange extending from the periphery of the base-plate in the direction of the tube axis, the flange having an elliptically cylindrical configuration. It is assumed that the longer diameter (or major axis length of the ellipse) of the pole pieces 50 is $\phi_{max}$, the shorter diameter thereof (or minor axis length of the ellipse) is $\phi_{min}$ and the outer diameter of the tube neck portion 1 is $\phi_o$. In order for the pole pieces 50 to effectively attract or absorb thereinto magnetic flux from the present magnet 8, the pieces are preferably selected to be as close to the inner diameter $\phi_i$ of the neck portion 1 as possible. On the other hand, the breakdown voltage characteristic of the neck portion demands the pieces to be positioned as far away as possible from the inner wall of the neck portion. To find a compromise therebetween, tests were conducted, and it was experimentally ascertained a relation of $0.65<\phi_{max}/\phi_o<0.92$ should preferably be satisfied. With regard to the piece holding strength, it is desirable to increase the thickness "$t_s$" is which inevitably accompanied by the decreased minor axis length $\phi_{min}$. Further, the minor axis length $\phi_{min}$ of the pole pieces, as will be hereinafter explained more in detail, depends greatly upon the beam spot size or STC characteristic and in order to obtain a higher performance, is preferably selected to be as close to the longer diameter $\phi_{max}$ of the pole pieces 50 as possible. In other words, it is desirable that the pieces 50 have a circular cross section. Therefore, the thickness "$t_s$" of the support rods 9 is determined by the strength required for support of the pole pieces 50. Our test showed that $t_s/\phi_o$ is preferably between 0.1 and 0.2.

As a result, it was found that ratio of flatness $\phi_{min}/\phi_{max}$ for the pole pieces is preferably between 0.69 and 0.89.

Figure 7:
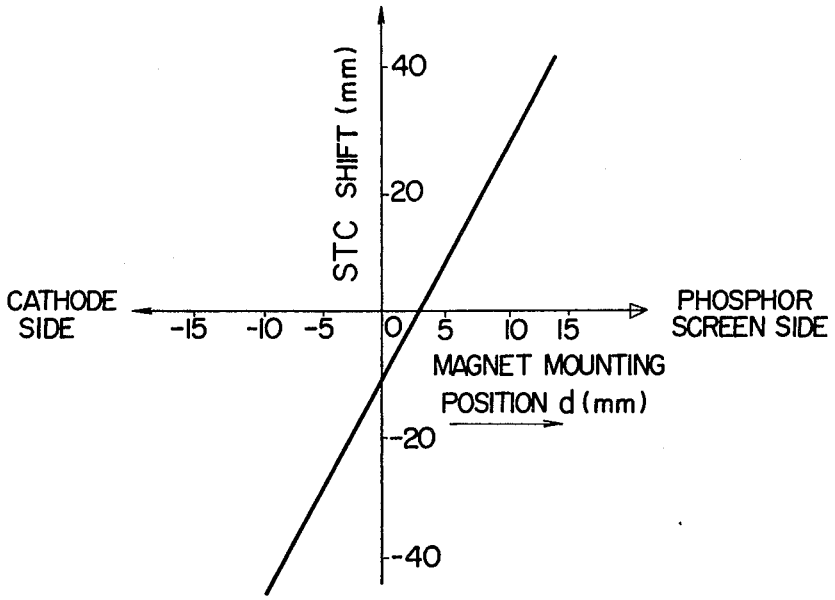
FIG. 7 is a graph showing the relationship of the STC deviation or shift to the magnet mounting position.

Next, as shown in FIG. 5, the permanent magnet 8 is placed so as to be shifted along the tube axis toward the side of the phosphor screen with respect to main magnetic focusing lens system 13. Mounting of the permanent magnet 8 onto the neck portion nearly at the same tube axial position as the lens system 13 in the conventional manner, will cause side beams to be deflected in the upper or lower direction ("y" direction), that is, the STC to be shifted. The shifted permanent magnet 8 acts to compensate for the resulting shift in the side beams. FIG. 7 is a graph showing the relationship of the STC shift in the side beams to the mounting position (a shifted distance of the permanent magnet 8 from the gap between the paired pole pieces in the tube axial direction) of the permanent magnet, when tests are carried out in connection with this embodiment of FIGS. 5 and 6. The STC shift is defined as a distance between the G (green) and R (red) beams in the "y" direction on the RGB region of the phosphor screen, where the distance is equal to a half the distance between the R and B (blue) beams thereon and when the R beam is directed to a higher position than the G beam, the value of the distance becomes positive. It will be readily seen from FIG. 7 that mounting of the magnet on the tube neck portion in an about 3 mm-shifted relation toward the screen side will cause the STC shift to become zero. Formation of pole pieces 50 into somewhat flat or substantially elliptical cross sections according to the present invention wil enable an "x"-directional magnetic field "Bx" in the magnetic characteristic to be relatively strong on the axis of the side beams 12S$_1$ and 12S$_2$ in the gap 5*b*, as compared with that in the case where the pole pieces are of conventional circular cross sections. This is because, with respect to the pole pieces 50, its "x" directional permeance will not change appreciably but its "y" directional permeance will become smaller, which means that the "x" directional permeance becomes relatively large. This will cause the STC of the side beams to shift largely in the "y" direction when compared with that in the conventional gun. On the other hand, positioning of the permanent magnet 8 on the neck portion in shifted relation toward the side of the phosphor screen as illustrated in FIG. 5, will cause an increase of magnetic flux supplied directly into the gap 5*b* from the face of the magnet 8 on the cathode side thereof, which magnetic flux acts to cancel the relatively increased amount of the "x" directional magnetic field "Bx" caused by the pole pieces 50 shaped into an ellipse section according to the present invention. This will be easily understood from FIG. 7.

Figure 8:
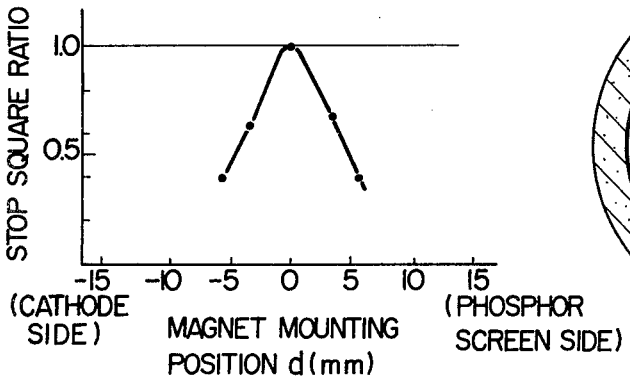
FIG. 8 is a graph showing the relationship of the beam spot configuration (the ratio of the longer diameter to shorter diameter of the spot formed on the phosphor screen) to the magnet mounting position.
Figure 9:
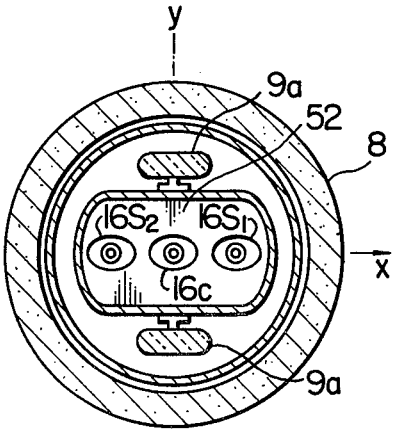
FIG. 9 is a transversal cross-sectional view of a gun pole piece provided with three apertures for beam passage and shaped into an ellipse whose major axis is aligned with the "x" direction of the whole picture tube in accordance with another embodiment of the present invention.

FIG. 8 is a beam spot characteristic, showing the relationship between the ratio of the longer diameter to shorter diameter of an image formed on the phosphor screen by the electron beam 12C, and the mounting position "d" of the permanent magnet. In the figure, a value 1.0 on the ordinate means that the profile of the beam spot is of a true circle and thus the tube is put in the best operating condition. As will be clear from FIG. 8, when "d" is 3.0 for STC=0 in FIG. 7, the spot profile is not of a true circle. However, by providing in magnetic pole pieces 52 apertures 16C, 16S$_1$ and 16S$_2$ for beam passage such that the apertures are of an ellipse configuration and the major axes thereof are registered with the "x" directional axis of the tube, as shown in FIG. 9; the profile of the beam spot can be made to be a true circle without changing a condition STC=0.

Figure 10:
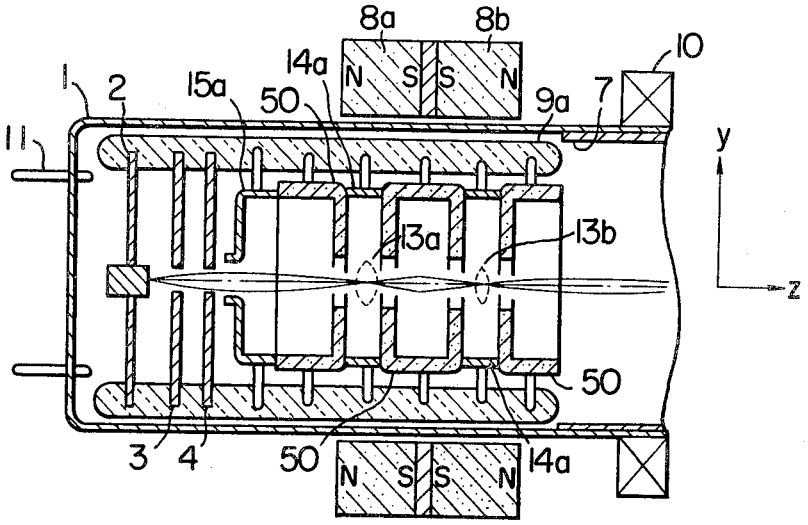
FIG. 10 is a longitudinal cross-sectional view of an electron gun in accordance with another embodiment of the present invention.

On the other hand, referring to FIG. 10, there is shown a magnetic focusing electron gun in which two external permanent magnets 8*a* and 8*b* are mounted on the tube neck portion so as to surround two magnetic lens systems 13*a* and 13*b*, and the two magnets are disposed so that their like pole faces oppose each other. Theoretically, the electron gun of this type must produce a high quality picture image for such reasons as rotation of the electron beam about its beam axis is substantially cancelled and spherical aberration is very small. However, it has been difficult, in the past, to actually assemble with high accuracy such an electron gun that is long in its axial direction of the tube to obtain its intended performance. According to the present invention, the intended high quality picture image can be easily obtained.

With the embodiments as have been disclosed above, there can be easily manufactured with high accuracy the magnetic focusing cathode-ray tube which is provided with the magnetic pole pieces to generate highly condensed magnetic fields.

Figure 1:
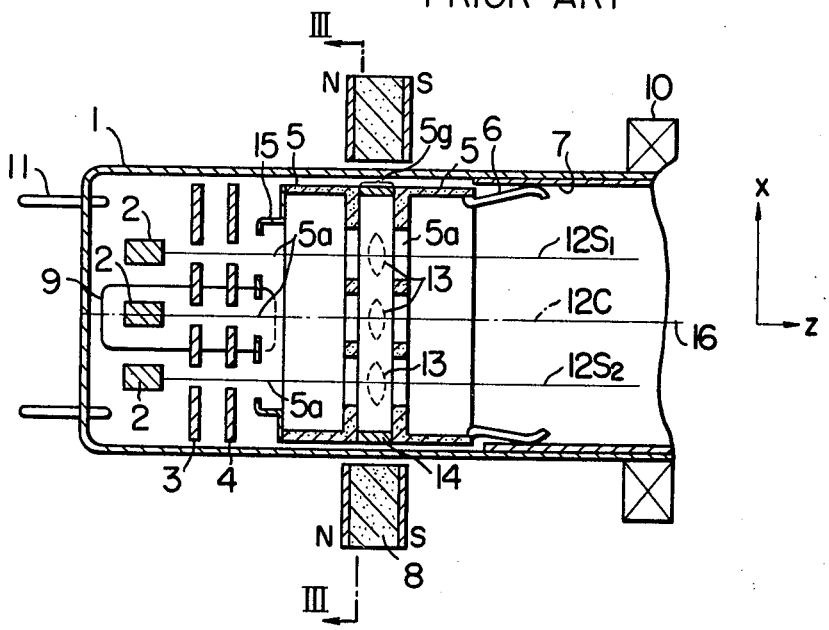
FIG. 1 PRIOR ART
FIGS. 1 and 2 show longitudinal cross-sectional views of a prior art electron gun portion in a magnetic focusing cathode-ray tube of three in-line gun, external magnet type, taken along different planes including an axis of the tube.
Figure 2:
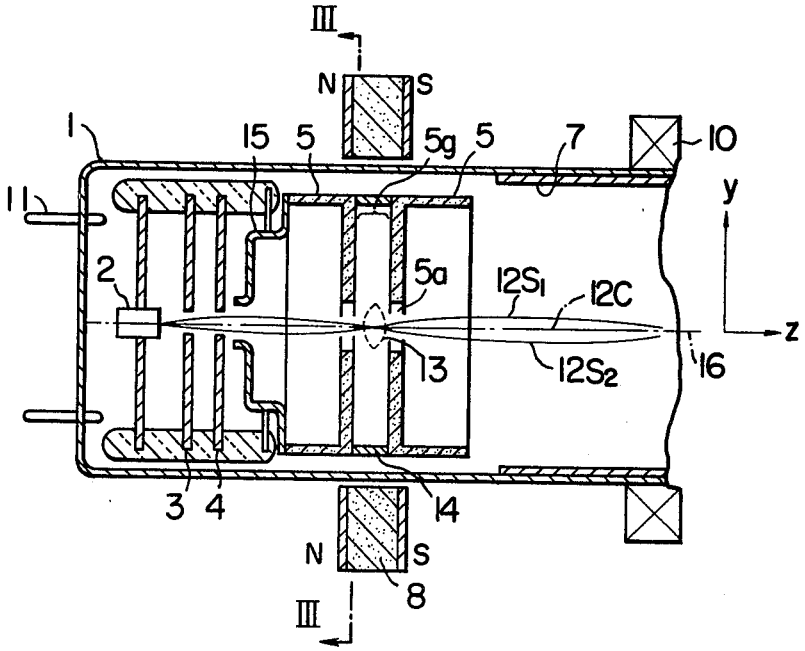
FIG. 2 PRIOR ART
Figure 3:
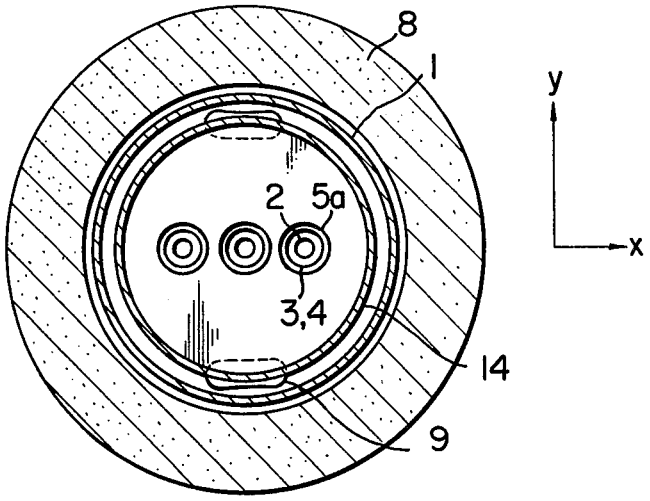
FIG. 3 PRIOR ART
FIG. 3 is a cross-sectional view of the same gun portion taken along line III—III in FIG. 1.
Figure 4:
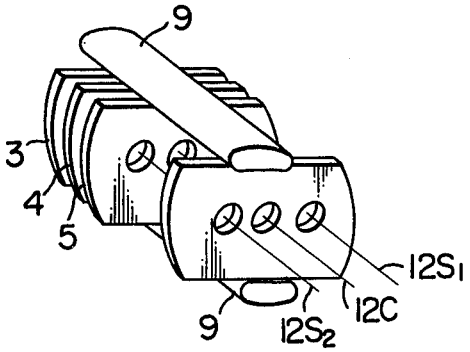
FIG. 4 PRIOR ART
FIG. 4 is a perspective view of a prior art assembly incorporated with sectionally non-circular pole pieces.
Figure 11:
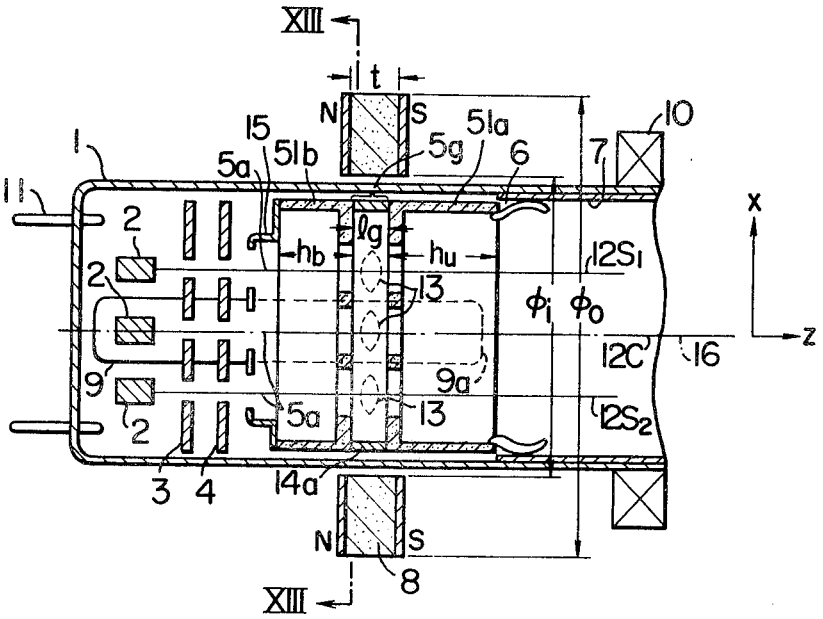
FIGS. 11 and 12 show longitudinal cross-sectional views of electron guns in accordance with a further embodiment of the present invention, taken along different planes including the tube axis.
Figure 12:
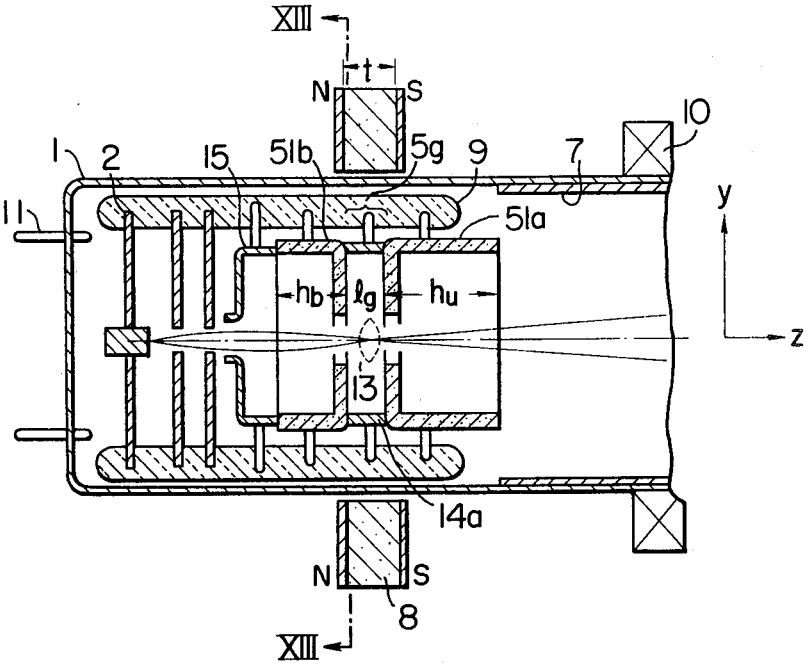
Figure 13:
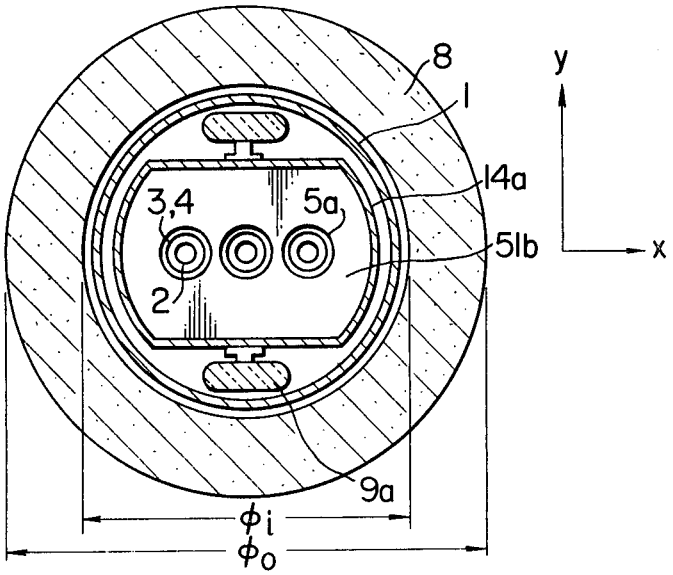
FIG. 13 is a schematic diagram of the electron gun for explaining the dimensions of the permanent magnet and neck portion of the tube.

An electron gun according to a further embodiment of the present invention is shown in FIGS. 11 to 13 in which FIG. 11 is a longitudinal cross sectional view of the gun taken along a three in-line plane, FIG. 12 is a longitudinal cross sectional view of the gun taken along a plane including the tube axis and perpendicular to the three in-line plane and FIG. 13 is a transversal cross sectional view of the gun taken along line XIII—XIII in FIG. 12. The embodiment of FIGS. 11 to 13 is substantially the same as that of FIGS. 1 to 3, except that magnetic pole pieces 51*a* and 51*b* and a gap electrode 14*a* are both shaped into somewhat flat or substantially elliptical configurations in their cross sections, and the gaps formed between the pole pieces 51*a* and 51*b* and the inner wall of the tube neck portion are used for respective common support rods 9*a* to support in the respective spaces the pole pieces 51*a* and 51*b* and gap electrode 14*a* as well as other electrodes.

Now, explanation will be directed to the size or dimensions of the permanent magnet 8 used in the gun of the magnetic focusing cathode-ray tube according to the present invention. The size of the magnet 8 is determined largely by two factors. One of the factors is a condition where the tube is in operation, more specifically, the outer diameter of the tube neck portion 1, the anode operating voltage, etc. The other factor is a condition where the amount of magnetic flux available from the permanent magnet becomes its maximum in order to obtain more highly focused field. The size of the magnet is selected so that the magnet operates at a maximum B·H product point (maximum permeance) on the B-H curve (which is determined by the material of the magnet). In view of the fact that this picture tube is intended for domestic or home application, it is most preferable under the existing circumstances to employ ferrite as the magnet material because of its high cost performance. Therefore, the present inventor employed ferrite magnet Hitachi Metal YBM-2B in his experiment. Table 1 lists exemplary ring magnets preferably available in the experiment on the basis of the above considerations. For example, Tube type 2 in Table 1 indicates that this size of magnet is used for a tube of 14 inch type, 90 degree deflection, and 21 kV anode operating voltage.

TABLE 1

| Tube type | Thickness (t) | Outer diameter ($\phi_o$) | Inner diameter ($\phi_i$) |
|---|---|---|---|
| ① | 9.0 mm | 46.0 mm | 26.0 mm |
| ② | 9.0 mm | 58.0 mm | 26.0 mm |
| ③ | 13.0 mm | 46.0 mm | 26.0 mm |
| ④ | 13.0 mm | 52.0 mm | 26.0 mm |
| ⑤ | 13.0 mm | 58.0 mm | 26.0 mm |
| ⑥ | 17.0 mm | 46.0 mm | 26.0 mm |
| ⑦ | 17.0 mm | 58.0 mm | 26.0 mm |

Further, in determining the dimensions of the permanent magnet 8, special attention should be paid to the leakage magnetic field from the magnet, since the deflecting yoke 10 is located in the vicinity of the magnet 8 as seen from FIG. 11 and the leakage field may have an adverse effect on the deflection magnetic field in the yoke. A way to avoid this is to make long the length of the tube neck portion 1 to thereby provide ample spacing between the permanent magnet and the deflecting yoke. This way, however, is restricted to some extent and not desirable because the depth of a television set must be correspondingly made long. In practical applications, it is often required that the thickness "t" of the magnet and/or the outer diameter $\phi_o$ be selected to be smaller than those listed in Table 1. Also, the spacing "lg" between the pole pieces 51*a* and 51*b*, of course, becomes a major factor at the time of determining said permeance. In addition, when the "lg" is too small, the magnetic lens becomes small and strong so that the spherical aberration increases; whereas, if the "lg" is too large, it becomes impossible to obtain a proper STC. When the thickness of the magnet is "t", the "lg" preferably lies between 0.3t and 1.0t (both inclusive), but in our tests, "lg" was used to 0.5t in most tests. As has been explained above, the shape or dimensions of the permanent magnet are determined greatly by the factors as mentioned above. Computer simulation and our tests showed that $\phi_o/\phi_i$ is desirably between 1.7 and 2.3 (both inclusive) and $t/\phi_i$ is desirably between 0.35 and 0.65 (both inclusive).

Figure 14:
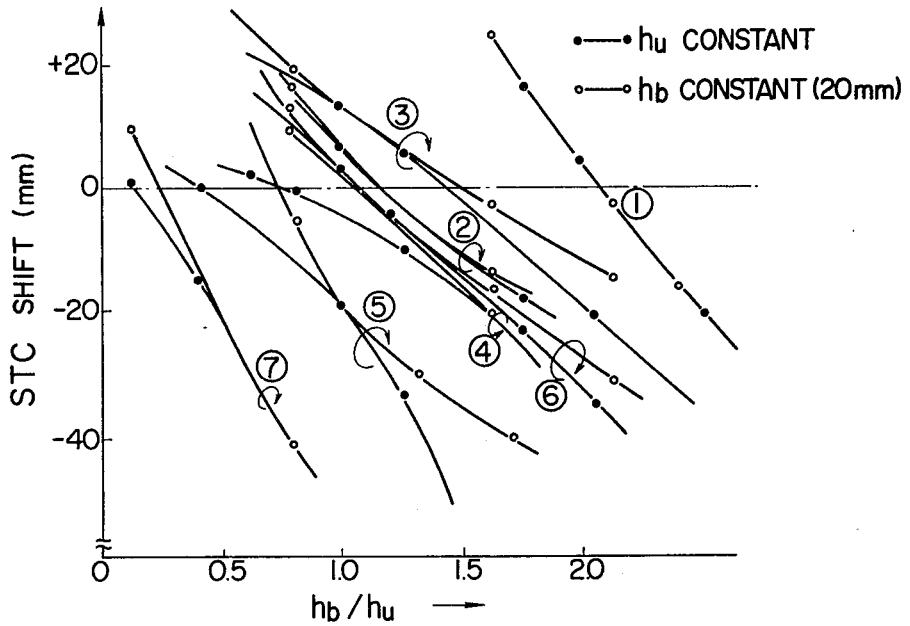
FIG. 14 shows a plurality of curves showing the relationships between the tube-axial length ratio "$h_b/h_u$" of said pole piece pair and the STC shift, with respect to different sizes of permanent magnets.

FIG. 14 shows curves obtained by our experiments, showing the relationships between the ratio $h_b/h_u$ of the tube-axial flange length $h_b$ (of the pole pieces 51*b* of the cathode side) to the tube-axial flange length $h_u$ (of the pole piece 51*a* on the side of the phosphor screen), and the STC shift, with respect to different sizes of permanent magnets listed in Table 1. The inventors contemplated that where, as will be obvious from FIG. 8, the permanent magnet 8 is positioned substantially in the middle of the gap between the pieces 51*a* and 51*b* so that the beam spot profile is of a true circle and the focused magnetic field is not subject to an appreciable adverse effect with respect to its rotary symmetry, the STC only can be varied with a true circle of the spot profile maintained, by changing the magnetic fields at the tip ends of the pole pieces 51*a* and 51*b*, that is, the lengths thereof, in order to achieve the above purposes.

In FIG. 14, the STC takes a positive value when the side beam $12S_1$ is located at an upper position along the "y" direction relative to the center beam 12C. Also, numbers ① to ⑦ correspond to those in Table 1. Curves with back dots correspond to characteristics when "$h_u$" is constant and "$h_b$" is variable, while curves with white dots correspond to characteristics when "$h_b$" is constant and "$h_u$" is variable. Further, the permanent magnet 8 is positioned at a position when the beam spot becomes a true circle, that is, substantially in the middle of the gap between the pole pieces 51*a* and 51*b*.

In order to make use of more magnetic field from the permanent magnet, in general, "$h_u$" is taken to be larger. However, for the reasons described earlier, it is impossible to actually take a very large value. As will be obvious from FIG. 14, there can exist certain desirable values of $h_b/h_u$ when the beam spot is circular and the STC is zero with respect to various sizes of magnets, and the values depend upon the shape or dimensions of the magnets. For example, it is clear that $h_b/h_u$ is 2.1 for magnet ①, $h_b/h_u$ is 1.13 for magnet ② and $h_b/h_u$ is 1.45 for magnet ③.

Figure 15:
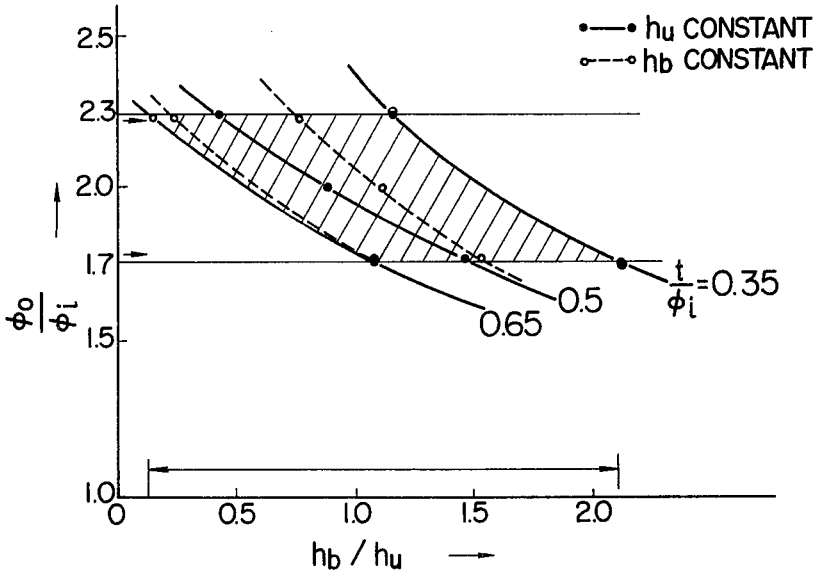
FIG. 15 shows a plurality of curves showing the relationships between the diameter ratio $\phi_0/\phi_i$ of the magnet and the axial length ratio "$h_b/h_u$" of said paired pole pieces, with respect to different ratios of the magnet thickness to the inner diameter of the magnet.

FIG. 15 is a graph showing relationships between the inner and outer diameters $\phi_i$ and $\phi_o$ of the magnet 8 and the pole piece lengths $h_b$ and $h_u$ to find desired values when the STC becomes zero from these test rsults, in which $h_b/h_u$ is measured on the abscissa and $\phi_o/\phi_i$ is measured on the ordinate as a function of $t/\phi_i$ ("t" is the thickness of the permanent magnet). That is, when the dimensions of the magnet 8 and magnetic pole pieces 51*a* and 51*b* correspond to values on the curves in FIG. 15, the beam spot can be made a true circle and the STC can be made zero in the resulting magnetic focusing cathode-ray tube. Slant lined region in FIG. 15 indicates the preferable $h_b/h_u$ range when the permanent magnets of the size referred to earlier are used according to the present invention.

While the present invention has been explained with reference to the preferred embodiments shown in the drawings, it should be understood that the invention is not limited to those embodiments but covers all other possible modifications, alternatives and equivalent arrangements included in the scope of the appended claims.

What is claimed is:

1. A magnetic focusing cathode-ray tube of three in-line gun type comprising magnetic field forming means provided externally of a neck portion of said tube, at least a pair of pole pieces made of magnetic material having high permeability arranged opposing each other within said neck portion in the axial direction of the tube so as to effectively absorb magnetic flux from said magnetic field forming means and to form magnetic focusing lens systems in a gap between said pole pieces, each of said pair of pole pieces including a base plate of a substantially elliptical configuration as viewed from a plane perpendicular to the tube axis, said base plate being provided with in-line beam passing through-holes, and a substantially elliptical cylindrical flange extending from the periphery of said base plate, said flanges of said pair of pole pieces extending in opposite directions in the tube axial direction, and support members disposed in respective spaces between said pair of pole pieces and an inner wall of said neck portion to support as a unit cathode and grid electrodes and said pair of pole pieces.

2. A magnetic focusing cathode-ray tube as set forth in claim 1 including a three in-line gun in which said magnetic field forming means externally of said tube neck portion is located as shifted toward the side of a phosphor screen from said magnetic focusing lens systems along the axial direction of the tube.

3. A magnetic focusing cathode-ray tube as set forth in claim 1 or 2, wherein an inner diameter $\phi$ of said tube neck portion and longer and shorter diameters $\phi_{max}$, $\phi_{min}$ of the substantially elliptical configuration each of said pair of pole pieces satisfy relations of $0.65<\phi_{max}/\phi<0.92$ and $0.69<\phi_{min}/\phi_{max}<0.89$.

4. A magnetic focusing cathode-ray tube as set forth in claim 3 wherein each of said support members has a thickness $t_s$ which satisfies the relation of $0.1\leqq t_s/\phi\leqq 0.2$.

5. In a color picture tube having an electron gun including a plurality of cathodes disposed in-line in a neck portion of said tube for generating center and side in-line electron beams, accelerating grid electrodes, and magnetic focusing means in the form of a pair of magnetic pole pieces of high permeability spaced in the axial direction of the tube and having through-holes disposed therein in-line in the axial direction of the tube for permitting said center and side electron beams emitted from the cathodes to pass therethrough, respectively, a cylindrical permanent magnet disposed around the neck portion of said tube for magnetizing said pair of magnetic pole pieces to produce a plurality of magnetic focusing lenses therebetween, each of said focusing lenses being present between mutually-opposed through holes of said pair of magnetic pole pieces so as to have a lens axis coinciding with a center-to-center line of the mutually-opposed through holes, and a phosphor screen, the improvement wherein each of said pole pieces is provided with a flange member extending away from the gap between the mutually-opposed pole pieces along the tube axis, said flange having a substantially elliptically cylindrical configuration so as to provide substantially sectionally arcuate spaces between the peripheral surface of the pole pieces and the inner wall of the neck tube sufficient to accommodate support rods for supporting the grid electrodes and the cathodes integrally with said pole pieces, and said cylindrical permanent magnet being disposed so that its center line perpendicular to the tube axis is disposed toward the phosphor screen with respect to a line perpendicular to the center axis of said magnetic focusing lens, said permanent magnet having opposite poles in the direction of the tube axis to thereby compensate mismatching of static convergence due to the non-circular pole piece configuration.

6. A magnetic focusing cathode-ray tube as set forth in any one of claims 1, 2 and 5 wherein each of said through-holes is of an elliptical shape whose major axis is registered with the in-line direction.

7. In a magnetic focusing cathode-ray tube of three in-line gun type wherein at least one ring-shaped permanent magnet surrounds a neck portion of the tube, at least a pair of pole pieces made of magnetic material having high permeability are arranged opposing each other within said neck portion in the axial direction of the tube so as to effectively absorb magnetic flux from said at least one permanent magnet and to form magnetic focusing lens systems in a gap between said pole pieces, a central plane of said at least one magnet perpendicular to the tube axis is substantially registered with a central plane of said magnetic focusing lens system perpendicular to the tube axis, the improvement in which the pole pieces are of a non-circular cross section as viewed from a plane perpendicular to the tube axis, cathode grid electrodes and the pole pieces in said gun assembly are supported as a unit by common support rods, outer and inner diameters $\phi_o$ and $\phi_i$ and a thickness t of said at least one permanent magnet made of ferrite material are selected to satisfy relations of $1.7\leqq\phi_o/\phi_i\leqq 2.3$ and $0.35\leqq t/\phi_i\leqq 0.65$, a length "lg" of said gap between the opposing pole pieces is selected to satisfy a relation of $0.3t\leqq lglg\leqq 1.0t$, and a tube-axial length $h_u$ of the pole piece disposed on the side of a phosphor screen of said pair of pole pieces and a tube-axial length $h_b$ of the pole piece disposed on the side of the cathode electrodes of said pair of pole pieces are selected to satisfy a relation of $0.15h_u\leqq h_b\leqq 2.04h_u$.

8. A magnetic focusing cathode-ray tube sas set forth in claim 1, wherein the substantially elliptical configuration of said base plate has the major axis thereof registered with the through-hole in-line direction, and said magnetic field forming means includes at least one ring-shaped permanent magnet of a ferrite material surrounding said neck portion of said tube.

9. A magnetic focusing cathode-ray tube as set forth in claim 8, wherein said at least one ring-shaped permanent magnet has outer and inner diameters $\phi_o$ and $\phi_i$ and a thickness t selected to satisfy relations of $1.7\leqq\phi_o/\phi_i\leqq 2.3$ and $0.35\leqq t/\phi_i\leqq 0.65$, a length "lg" of the gap between opposing pole pieces is selected to satisfy a relation of $0.3t\leqq lg\leqq 1.0t$, and a tube-axial length $h_u$ of the pole pieces disposed on the side of a phosphor screen of said pair of pole pieces and a tube-axial length $h_b$ of the pole piece disposed on the side of the cathode electrodes of said pair of pole pieces are selected to satisfy a relation of $0.15h_u\leqq h_b\leqq 2.04h_u$.

10. A color picture tube as set forth in claim 5, wherein each of said pole pieces includes a base plate with said flange member extending from the periphery of said base plate, said base plate having a substantially elliptical configuration with the major axis of the configuration of said base plate and said flange member being registered with the in-line direction, the elliptical shape of said through-holes enabling the shaping of an electron beam passing therethrough to a circular shape.

* * * * *